US010112686B2

(12) United States Patent
Austin et al.

(10) Patent No.: US 10,112,686 B2
(45) Date of Patent: Oct. 30, 2018

(54) SYSTEM FOR THE DEPLOYMENT OF MARINE PAYLOADS

(71) Applicant: Woods Hole Oceanographic Institution, Woods Hole, MA (US)

(72) Inventors: Thomas Austin, Falmouth, MA (US); Michael Purcell, North Falmouth, MA (US); Robin Littlefield, Falmouth, MA (US); Frederic Jaffre, East Falmouth, MA (US); Gwyneth Packard, Bourne, MA (US); Glenn McDonald, Marston Mills, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 0 days.

(21) Appl. No.: 15/009,991

(22) Filed: Jan. 29, 2016

(65) Prior Publication Data

US 2016/0221655 A1 Aug. 4, 2016

Related U.S. Application Data

(60) Provisional application No. 62/109,994, filed on Jan. 30, 2015.

(51) Int. Cl.
*B63B 1/00* (2006.01)
*B63B 5/00* (2006.01)
(Continued)

(52) U.S. Cl.
CPC ..... *B63B 22/08* (2013.01); *B63B 22/003* (2013.01); *B63B 2022/006* (2013.01)

(58) Field of Classification Search
CPC . B63G 8/00; B63G 8/001; B63G 8/04; B63G 8/14; B63G 8/22; B63G 2008/001; B63G 2008/002; F41F 3/00
(Continued)

(56) References Cited

U.S. PATENT DOCUMENTS 2,398,794 A * 4/1946 Maltby ..... F42B 22/44 102/411
3,516,380 A * 6/1970 Johnston ..... F41F 3/10 114/238
3,720,165 A * 3/1973 Dinsmoor ..... F42C 11/005 102/216
(Continued)

FOREIGN PATENT DOCUMENTS

GB 191511164 A * 6/1916 ..... F41F 3/10

OTHER PUBLICATIONS

C.G. Rauch, et al.; AUV Deployed Marking and Homing to Targets; IEEE; Proceedings of Oceans' 08, 2008; Woods Hole Oceanographic Institution; pp. 1-5; Woods Hole, MA.

*Primary Examiner* — Daniel V Venne
(74) *Attorney, Agent, or Firm* — Jessica C. Engler; Russel O. Primeaux; Kean Miller LLP

(57) ABSTRACT

The present invention involves a system for the release of low relief, self-orienting deployable payloads from a platform such as an underwater vehicle and a mechanism of passive buoyancy compensation of the vehicle. The system secures one or more payloads by a vacuum force without an additional mechanical restraining mechanism and deployment of a payload is accomplished by disengaging the vacuum hold to release the payload for its intended function. Once deployed, the payload may reorient itself to a functional orientation without additional assistance.

17 Claims, 8 Drawing Sheets

(51) Int. Cl.
*B63B 22/08* (2006.01)
*B63B 22/00* (2006.01)

(58) Field of Classification Search
USPC ..... 114/238, 239, 312, 313, 316, 317, 318, 114/319, 320, 321, 322, 324, 325, 330, 114/333, 20.1, 25
See application file for complete search history.

(56) References Cited

U.S. PATENT DOCUMENTS 3,870,263 A 3/1975 Hardiman et al.
4,738,421 A * 4/1988 Green ..... G10K 11/006 248/168
4,967,683 A * 11/1990 Brake ..... B63B 22/003 114/312
5,022,470 A * 6/1991 Andersen ..... E21B 7/008 175/14
5,163,379 A 11/1992 Chorley
5,666,900 A * 9/1997 Carroll, III ..... B63G 8/00 114/238
6,380,857 B1 4/2002 Galloway et al.
6,474,254 B1 11/2002 Ambs et al.
6,701,819 B1 * 3/2004 Williams ..... F41F 3/07 114/238
8,171,873 B2 5/2012 Woolwright et al.
8,274,861 B1 9/2012 Marn et al.
2010/0107959 A1 * 5/2010 Israel ..... B63B 22/003 114/312
2012/0298029 A1 11/2012 Vosburgh et al.
2013/0228117 A1 9/2013 Edwards
2015/0158587 A1 6/2015 Patrick et al.
2015/0175244 A1 * 6/2015 Webster ..... B63B 35/04 114/331

* cited by examiner

SYSTEM FOR THE DEPLOYMENT OF MARINE PAYLOADS

CROSS REFERENCE TO RELATED APPLICATIONS AND PUBLICATIONS

This application claims priority to and the benefit of U.S. Provisional Patent Application Ser. No. 62/109,994, filed Jan. 30, 2015, the disclosure of which is hereby incorporated herein by reference in its entirety. The entire contents of all patents and publications referenced in the specification are incorporated by reference.

Statement of Rights to Inventions Made Under Federally Sponsored Research

This invention was made with U.S. Government support under N00014-08-0165 awarded by the Office of Naval Research. The U.S. Government has certain rights in this invention.

FIELD OF THE INVENTION

The present invention relates to the field of marine study and exploration. Specifically, this invention involves a system for the release of deployable objects from a platform such as an aquatic vehicle and a mechanism of passive buoyancy compensation of the vehicle.

BACKGROUND OF THE INVENTION

Marine vehicles are used in a wide range of applications including exploration, military practices, and scientific research amongst others. In many applications, these vehicles are entirely or at least partially remotely controlled from another location such as a ship, vessel, or land base and use a plurality of payloads including instruments such as modems, beacons, markers, acoustic transmitters, acoustic transponders, hydrophones, sensors, seismometers, mines, munitions and similar devices. These instruments are often deployed on the seafloor or on bottom of a body of water for purposes of observation and communication, but are also employed for underwater navigation and tracking involving the integration of acoustic network devices with submersible vehicles to track targets and triangulate locations precisely.

Precise navigation during operation is a fundamental requirement for many underwater missions, and maintaining a steady course and buoyancy level is of significant concern. As a vehicle moves through the water and deploys a payload from the hull, the weight of the vehicle is reduced and the buoyancy increased. Without a method to immediately compensate this change, the vehicle may shift off course, adding a substantial variable of error to the mission. While methods involving air bladders and gas release are often used to compensate for buoyancy changes, these methods are unsuited for many operations including clandestine missions where the emission of gas bubbles is highly undesirable. Therefore, a muted or more subtle system and method are needed.

Another aspect of the deployment system is controlling how the deployed payloads are positioned for optimal functional operation. Once the payload has exited the vehicle, it may land in one of many positions on the underlying surface. To limit additional interaction and adjustment with the vehicle, the payload is required to re-orient and stabilize itself prior to its designated use. In such cases, a self-orienting payload provides the necessary means to complement such a system with a reduced detectable presence in the water.

With the growing emphasis on ocean exploration and navigation, an adaptive system for efficient and low profile payload deployment is highly beneficial to save time and labor costs associated with the use of submersible or water vehicles.

SUMMARY OF THE INVENTION

The present invention describes an improved system with an assembly integrated into or with the body of a platform, such as the hull of a vehicle, which comprises a plurality of deployable payloads held in place by a vacuum force which may be remotely designated to release the vacuum seal, dependently releasing one or more payloads to a desired position such as over the seafloor or the bottom of any body of water. When the release of the payload is initiated, fluid is allowed to flood the internal storage cavity of the assembly comprising the deploying payload, breaking the vacuum force, and passively compensating for at least a partial portion of the changes in weight of the deployed payload.

Additionally, the inventive system describes a deployable payload of a suitable weight and dimension to allow the capability of being held solely by the force of a vacuum (i.e., without an additional mechanical restraining mechanism). In many embodiments, these payloads are of a relief such that such objects rest on the seafloor and do not require additional anchoring. Furthermore, the deployable payloads are designed with a time-delayed, self-orienting mechanism to capably allow reorientation and/or self-leveling at the desired underwater position after deployment.

One purpose of this invention is to provide a system and assemblies that may be scaled and incorporated into a wide range of platforms including aquatic vehicles such as human-occupied vehicles (HOVs), remote operated vehicles (ROVs), autonomous underwater vehicles (AUVs), unmanned underwater vehicles (UUVs), gliders, towed vehicles, surface crafts, submarines, mini-submarines, boats, vessels, and any other suitable vehicles. It is even envisioned that the system described herein may be utilized in aerial vehicles particularly with the use of the self-orienting payloads.

In some embodiments of the present invention, the system may be used to deploy payloads such as markers, beacons, light devices, or other signaling objects to mark specific locations underwater such that the signaling payload may relay a signal immediately or at a later designated time to an aquatic vehicle, observatory, remote location, or other signaling object or payload. In some circumstances, the signaling payloads may be deployed to mark underwater mines, munitions, or other possible obstructions or hazards. In other cases, signaling payloads may be deployed to mark the location for the future deployment of mine or munitions. For such operations, the system allows for quiet and potentially silent deployment of payloads for stealth or reconnaissance missions as well as minimalized drifting of the system during deployment with the buoyancy compensation mechanism.

In some embodiments, the inventive system is utilized to deploy underwater signaling devices such as acoustic communication devices, optical communication devices, sensors, robots, actuators, lights, strobes, cameras, or samplers for the establishment of underwater communication networks comprising of underwater vehicles, observatories, modems, as well as a plurality of other communication or observation devices. However, one skilled in the art would immediately recognize other potential uses for the inventive system.

In operation, the vehicle or platform comprising the inventive system moves through the water to typically a target position. Upon arrival to said position, one or more stowed payloads is triggered to release and deploys from the hull of the vehicle onto the seafloor or underlying terrain. In concert with the release of the payload is the buoyancy compensation mechanism wherein the weight lost by the deployment of the payload is instantly compensated by a weight of fluid of the surrounding water. Consequently, the vehicle experiences minimal or no change in ballast which conserves costly energy and may continue on to the next destination.

Once deployed, the payload falls and contacts the underlying surface. The leg release mechanism disengages the leg assembly, allowing the legs to release and pivot from their point of attachment to the payload. The legs then contact the ground and generally push the payload into a substantially upright position or at least a functional position.

DETAILED DESCRIPTION OF THE PREFERRED EMBODIMENTS

Figure 1:
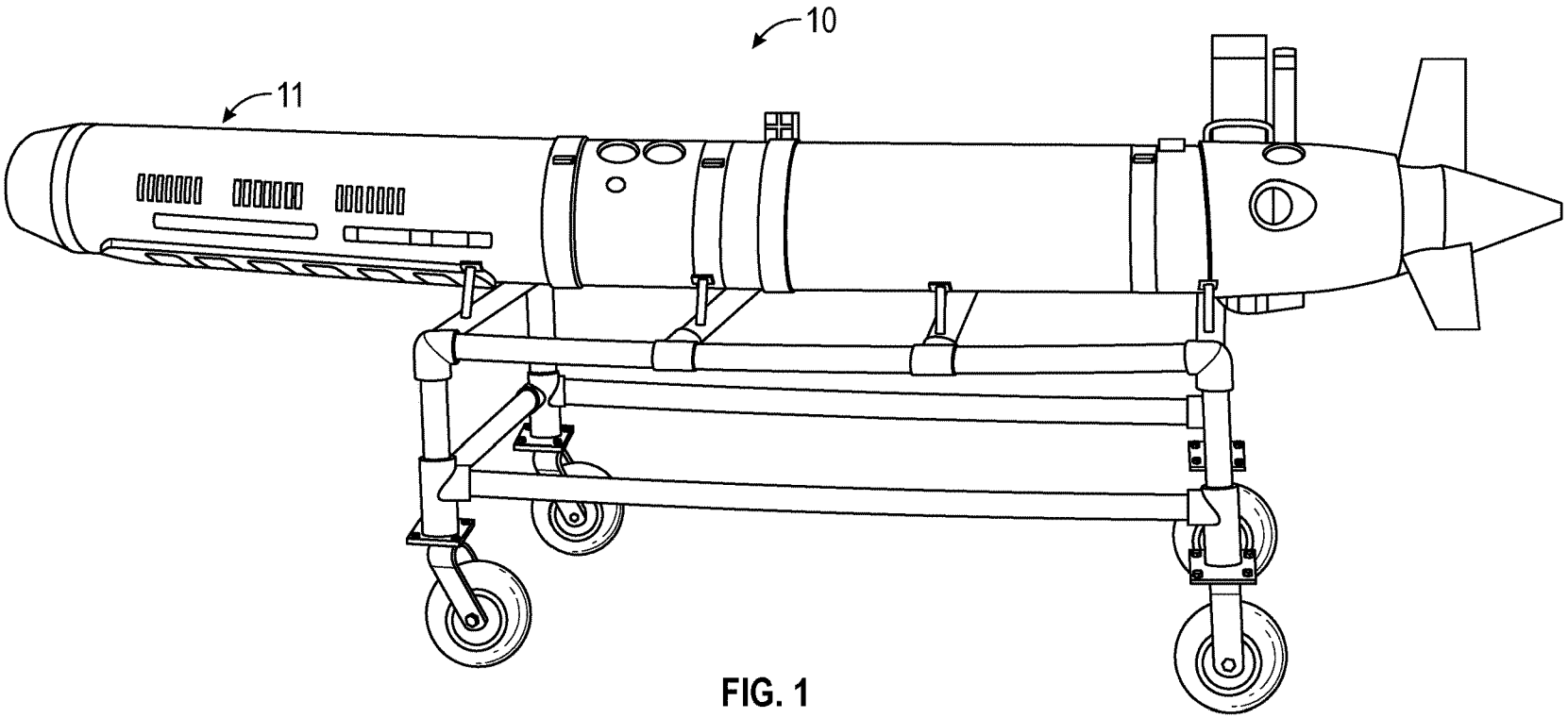
FIG. 1 depicts an image of a vehicle comprising the inventive assembly. The carrier is loaded with deployable payloads in the underside hull of the vehicle, according to one illustrated embodiment.

The preferred embodiment of this invention comprises an underwater vehicle for the deployment of at least one payload (such as beacons, markers, hydrophones, sensors, mines, munitions, communication modules (e.g., acoustic or optical communication nodes) or other devices in water. In the preferred embodiment shown in FIG. 1, the underwater vehicle for the deployment of at least one payload in water, further comprising the carrier 11, utilizes an aquatic vehicle 10 (i.e., an AUV) for the deployment of at least one payload in a body of water such as an ocean or lake by an aerial vehicle. This vehicle is distinguished from other systems presently known in the art by its use of a vacuum-based mechanism in lieu of a mechanical restraining mechanism to restrain and deploy payloads. The restraining vacuum is broken (i.e., vacuum force is released and can no longer hold the payload in the vehicle) during payload deployment through the admittance of activation of actuators and valves to release the retained payload. In one embodiment, the inflow of water during payload release also provides a simple and highly effective buoyancy compensation method where the weight of the deployed payload is at least partially replaced with water. The buoyancy compensation method immediately balances the difference in platform weight and allows the platform (i.e., an aquatic vehicle 10) to continue its course with little to no interruption in direction or speed while conserving energy.

The payload 19 remains held in the deployment chamber 12 until deployment is initiated. When deployment is initiated, actuator 16 and actuator switches 21—referred to collectively as the actuation assembly—active the sliding of valve 20 which allows an inflow of fluid from the external environment to enter the internal wet space 18 and break the vacuum seal. The payload 19 is released and drops to the underlying floor.

The elimination of mechanical restraints both reduces weight and eliminates noise associated with moving parts, thereby making the inventive system advantageous for stealth deployment of underwater objects in clandestine missions or in operations in which require little to no environmental disturbance such as research observational studies.

In an additional embodiments, the underwater vehicle for the deployment of at least one payload in water is employed in a less mobile manner disposed on the water surface, in the water column above the seafloor, or directly on the seafloor to deploy payloads within the vehicle's vicinity. In a further additional embodiment, more than one vehicle comprising the inventive system may be necessary to deploy more payloads for the desired operation.

Figure 2:
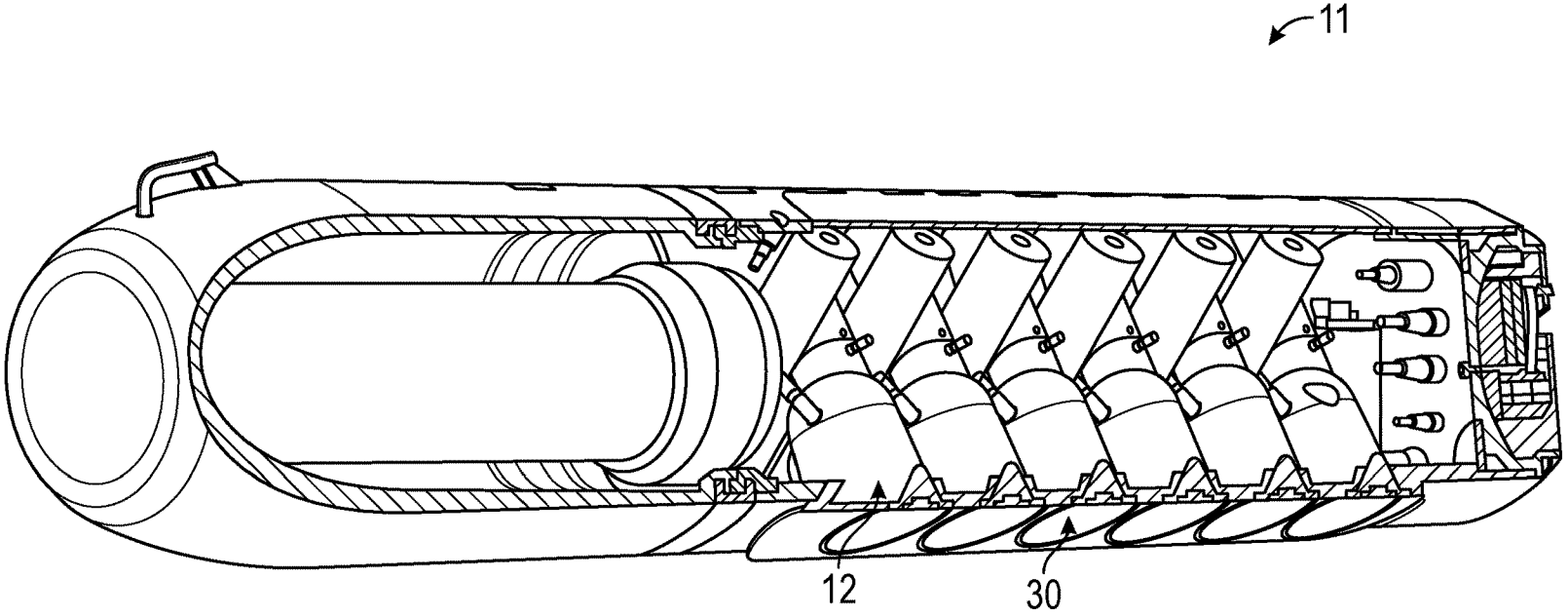
FIG. 2 shows a detailed schematic depicting the internal cavity of the carrier and the contained deployment chambers.

As shown in FIG. 2, the carrier 11 comprises and holds one or more internal storage cavities within the hull or body of the aquatic vehicle 10, referred to as deployment chambers 12, which hold the payloads 19 for deployment to the external environment. In general, the carrier 11 provides the housing or containment for the deployment chamber(s) 12. In the preferred embodiment, the deployment chamber 12 comprises a water-tight dry space 17, an internal wet space 18 for holding the payload 19 and capable of creating a vacuum seal with the payload 19, a portal 30 adapted to receive and release of the payload 19 through its opening, and a seal-breaking means to initiate development.

In one embodiment, the carrier 11 is a separate housing unit which may be connected directly to another vehicle segment (as shown in FIG. 1) or may be in hull of the vehicle wherein the deployment chambers 12 are arranged inside the vehicle's internal cavity. In another embodiment, the carrier 11 is a separate housing that is mounted or attached to an external surface of a vehicle by any suitable means including but not limited to a mount, bracket, strap, or other such attachment. Additionally, the carrier 11 also provides for the necessary electrical and vacuum connections with each deployment chamber 12 to secure the payload 19 within the carrier 11 until deployment is desired. The carrier 11 is operatively connected to a vacuum source such that, when the deployment chamber 12 is fully sealed and/or closed off to the external environment, a vacuum force may be generated and maintained within the cavity of the deployment chamber 12. In several embodiments, the vacuum source is an integrated component of the vehicle 10 which is actuated to create a vacuum force in each chamber 12 when a payload 19 is present. In most cases, the payload 19 seals with the deployment chamber 12 and maintains the vacuum even after the vacuum source is no longer active.

Figure 3:
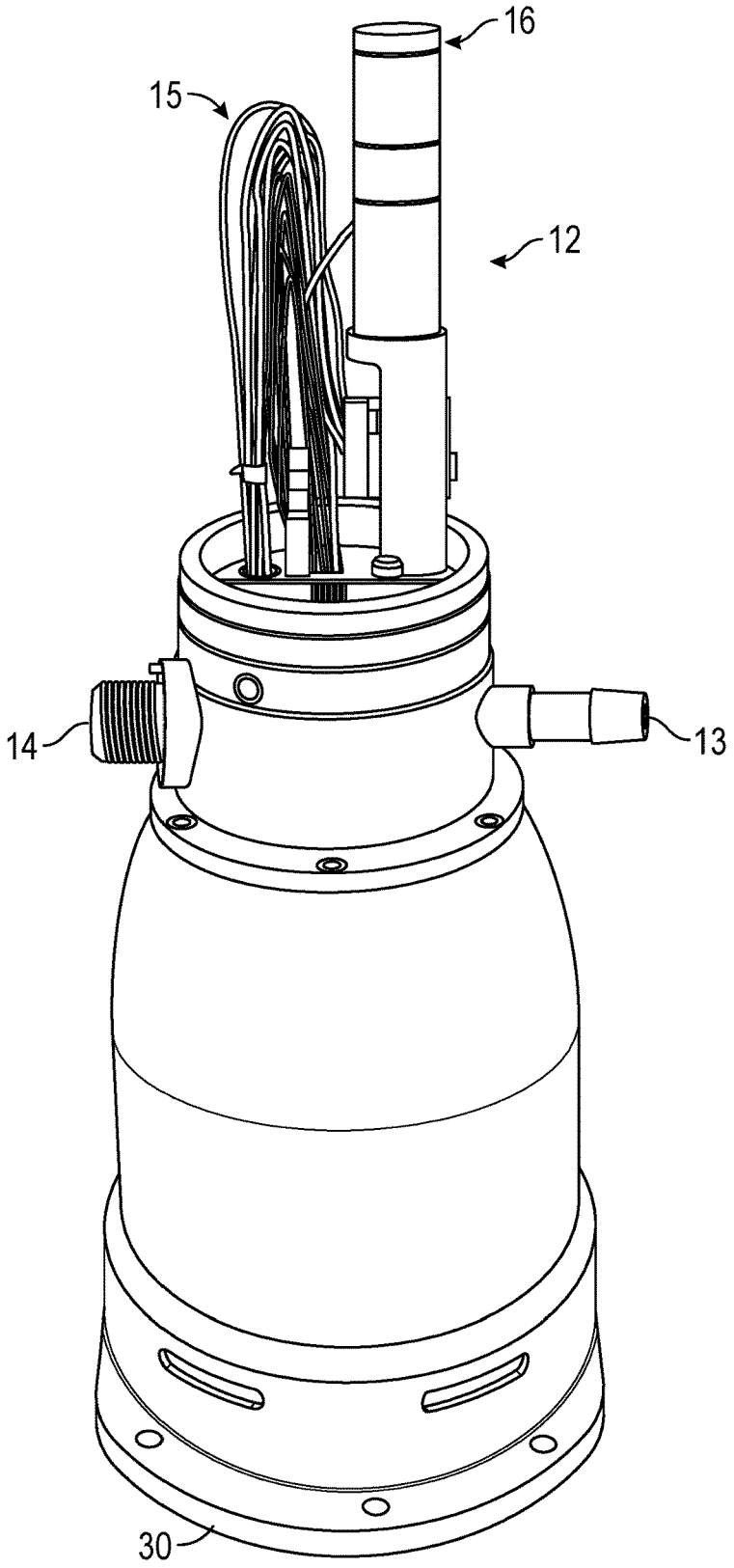
FIG. 3 depicts an external view of the deployment chamber including the electronics and circuitry, the actuator, and the associated ports, according to one embodiment.

The deployment chamber 12, shown in FIGS. 3 and 4A, comprises a vacuum port 13 to connect to the vacuum source and provide the vacuum force to secure the payload 19 within the chamber 12, an electrical port 14 adapted to connect and receive power and/or data information (such as the data communication and identity assignment described below) from a power source such as the vehicle 10 or a battery, electronics and circuitry 15 to control the process of payload deployment, one or more valves 20 (e.g., slide valve, spring valve, piston valve, Corliss valve, sleeve valve, ball valve) to break the vacuum seal and control the admission of fluid into the deployment chamber 12, and an actuator 16 and actuator switches 21 to mechanically drive the process of deployment and break the vacuum seal holding the payload 19. In one embodiment, the battery may be integrated within the deployment chamber 12.

Figure 4A:
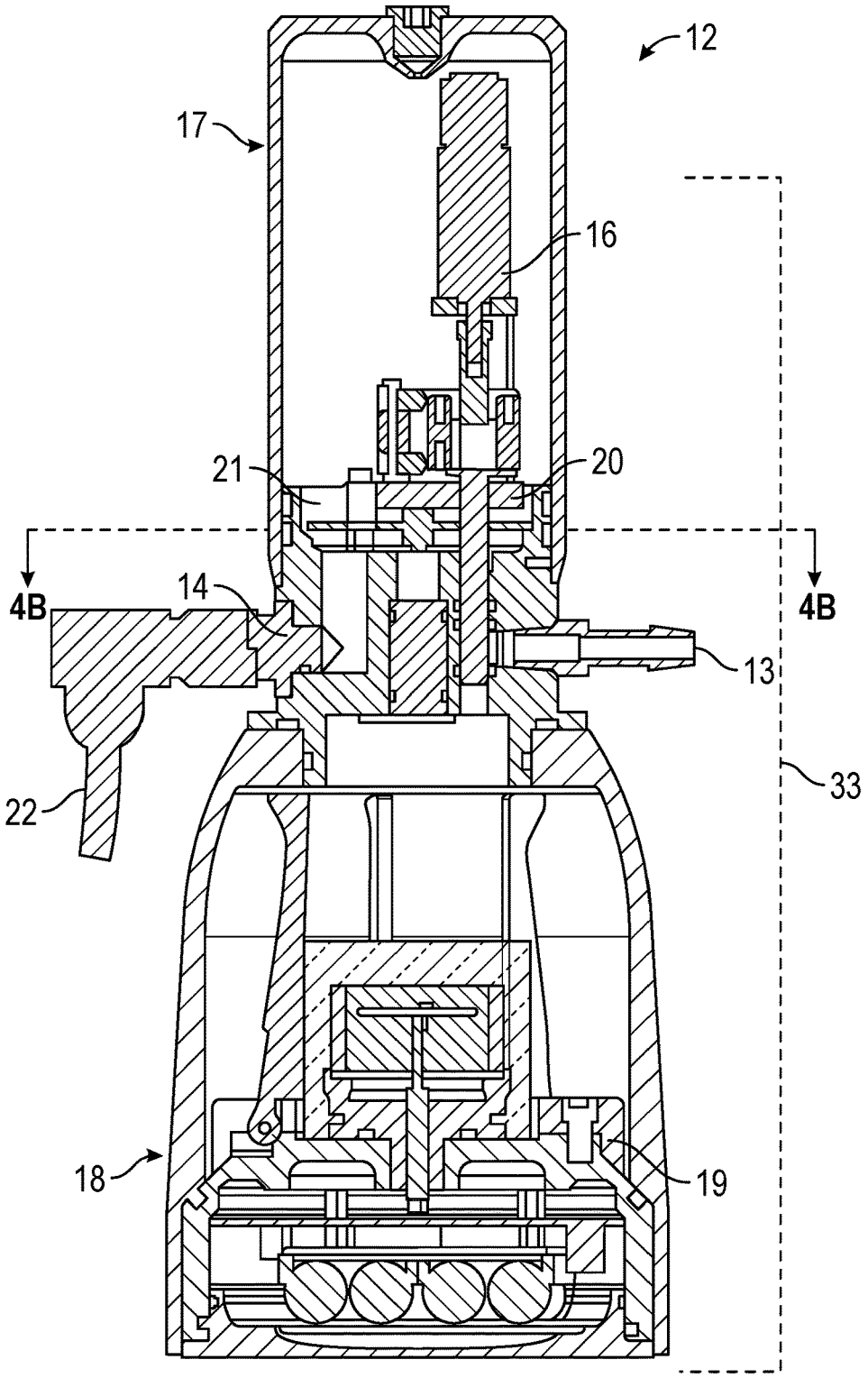
FIG. 4A depicts one embodiment of the internal components of the deployment chamber in a cross-sectional view.
Figure 4B:
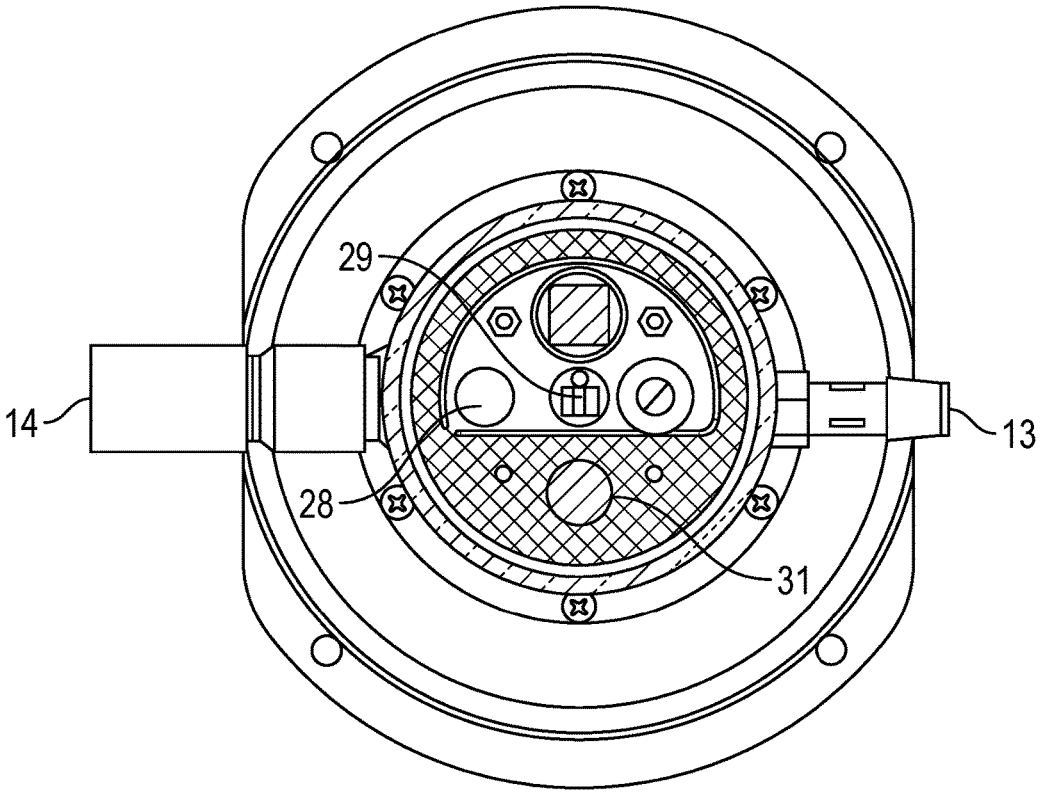
FIG. 4B depicts an alternative view of one embodiment of the internal components of the deployment chamber, which illustrates a portion of the dry space of the deployment chamber including the electrical port and path for electrical connection, components of the vacuum actuation mechanism including the vacuum port and the valve, and data communication path.

In the preferred embodiment, the deployment chamber 12 includes both a dry space 17 and an internal wet space 18 as shown in FIG. 4A. The dry space 17 comprises many of the previously described components, but not limited to, the electronics and circuitry 15, at least one actuator 16, at least one valve 20, additional valve assemblies (e.g., actuator switches 21), at least one seal to exclude liquid from the dry space 17, at least one port, and any additional connectors. As depicted in FIG. 4B, the electrical port 14 also provides a water-tight path 28 to connect to the electronics and circuitry 15 within the dry space 17.

The internal wet space 18 contains the payload 19 with which components in the dry space 17 may engage with without exposing the dry space 17 to the external environment. The dry space 17 engages with the internal wet space 18 in aspects such as to create a vacuum force to hold the payload 19, to initiate deployment of the payload 19, to optionally provide electrical charge to the payload 19, among other connections as deemed necessary by one skilled in the art. Upon the initiation of deployment, components in the dry space 17 employ the opening of valve(s) 20 and related tasks to break the vacuum seal and allow the external environment into the internal wet space 18, thus breaking the vacuum force holding the payload 19 within the internal wet space 18 and resulting in the deployment of the payload 19. During deployment process, the presently void internal wet space 18 may accept a volume of fluid of a weight, volume, and/or density to compensate for the weight, volume, and/or density of the deployed payload 19.

In preferred embodiment, the deployment chamber 12 in the carrier 11 holds the payload 19 by use of a vacuum force with little or no additional mechanical restraint mechanism (e.g., springs, hinges, fasteners, pins, supports, lids). In an additional embodiment, the deployment chamber 12 holds the payload in the absence of a mechanical restraining mechanism. Similarly, the deployment chamber 12 most often does not require an additional mechanical assist to deploy the payload 19 such as a compressed spring or similar means within the chamber 12 to push, project, or otherwise expel the payload from the internal wet space 18.

In most cases, the deployment chamber 12 is capable of connection to a vacuum pump or the equivalent thereof to provide the vacuum force upon the stowed payload 19. The vacuum force is created within the cavity of the deployment chamber 12 by the vacuum actuation mechanism, which comprises a vacuum port 13 adapted to connect with a vacuum source via a vacuum line 22. In one embodiment, the vacuum actuation mechanism further comprises a vacuum pump which may be installed on or within the vehicle, although in other embodiments, the vacuum port 13 connects with a vacuum line 22 such as a hollow tube, pipe, or chamber to a point where an external vacuum pump can be connected to draw a vacuum force on the cavity of chamber 12.

The vacuum force and the vacuum seal are created to secure the deployable payload 19 in the carrier 11. In one embodiment, the deployable payload 19 is loaded into the vehicle, and the vacuum actuation mechanism is initially engaged to create the vacuum hold on the payload 19 and is then disengaged once the seal has been achieved between the payload 19 and the chamber 12. In other embodiments, the vacuum actuation mechanism is continually engaged or periodically engaged during the system operation to maintain the vacuum force securing the payload 19 within the deployment chamber 12.

Other components may be installed with or within the system to support the creation and release of the vacuum force including but not limited to seal-breaking means (e.g., actuation assembly), valve assemblies, seals, o-rings, valves (e.g., slide valves, vacuum valves, in-line valves, gate valves, water-tight valves, gas-tight valves, ball valves), flanges, bearings, etc. as would be found suitable in the art.

A pressure sensor 31 may be included in one embodiment to sense or measure the pressure of the vacuum force within the deployment chamber 12, as illustrated in FIG. 4B.

The deployment chamber 12 is of a suitable volume and size to accommodate the desired deployable payload 19 as shown in FIG. 4A. In general, any size, shape, or fitting may be suitable as long as the payload 19 may be maintained within the chamber 12 by vacuum force. Additionally, the shape and fit of the chamber 12 must be designed so that the vehicle maintains the desired degree of vehicle buoyancy (e.g., no buoyancy change, partial buoyancy change) after deployment of the payload 19. A snug fit is most often preferred, wherein the inner contours of the chamber 12 to some extent match the outer contours of the payload 19. The base of the payload's water-tight body housing 23 fits substantially nested against the inner wall of the deployment chamber 12 to allow a vacuum seal to be maintained even underwater. In many embodiments, when the payload 19 is present within the chamber 12, additional free space will be less than 10% of the total portal volume. Such designs and other designs to minimize or maximize the additional free space are known in the art.

The deployment chamber 12 itself is fabricated to provide and hold a vacuum-tight seal at least in the internal wet space 18 and generally a water-tight seal in the dry space 17 to avoid water leakage into any other undesirable section of the carrier 11. The deployment chamber 12, specifically the deployment portal 30, must be capable of sealing with a vacuum-tight seal and maintaining said seal until deployment of the payload 19 is desired. In most instances, the deployment portal seal will be present as part of the payload 19, although when necessary, other simple flaps, lids, or covers may be used to provide or assist the vacuum seal. In such alternative cases, the seals may be free standing or have some flexible attachment to the vehicle (e.g., a tape, strap, or breakable hinge). A seal such as an O-ring may line the inner circumference of the deployment chamber 12 or the outer circumference of the payload 19 to further assist in maintaining the vacuum seal. In all cases, consideration must be made regarding the intended depth of use of the invention, and the deployment portal's vacuum seal and its components must be able to resist not only the applied vacuum but also the externally generated pressure at the depth of use.

The carrier and deployment chamber can be constructed from a variety of materials. In one embodiment, the carrier 11 and/or the deployment chamber 12 are comprised of metal such as steel, stainless steel, aluminum, cast iron, titanium, metal alloys, or other suitable material of a solidity appropriate for stresses of aquatic environments including moisture, pressure, and salt. In an additional embodiment, the carrier 11 and/or deployment chamber 12 are fabricated from carbon fiber, carbon fiber composite, carbon fiber-reinforced polymer, or similar material. Thermoplastics or mechanical grade plastics could also be utilized. In an additional embodiment, the carrier 11 is composed of aluminum to reduce overall weight of the vehicle. In a further embodiment, the carrier 11 is constituted from steel or steel alloy for overall strength. In a further embodiment, the carrier 11 is comprised of corrosion-resistant materials to prevent deterioration due to wet and/or salty conditions. Protective coatings and/or laminations may be appropriate to further protect the water-exposed portions of the carrier 11 such as zinc coating, chrome plating, paint, epoxies, etc. Galvanization processes may be applied to the components of the carrier 11 to prevent deterioration. It should be understood that the following materials are intended to serve as examples of the different materials that can be used for the carrier and deployment chamber and that nothing in this application should be interpreted to restrict the invention's construction to the above listed materials.

There is no restriction on the carrier's integration to the vehicle, regardless of whether the carrier 11 is a stand-alone segment meant to attach to a vehicle or connect with another segment of a vehicle. In one embodiment, the carrier 11 is integrated into the hull of a vehicle in a downward facing orientation. In another, the carrier 11 is integrated into a side or multiple sides of the hull or the carrier 11 is located in the posterior or the anterior region of the hull.

Deployable Payloads. In the preferred embodiment, at least one deployable payload 19 is loaded and stowed into the deployment chamber 12 of the carrier 11. Depending on the operator's application, the system can make use of as many payloads as needed by the operator. Each payload 19 and associated chamber 12 is designed to allow the payload 19 to be securely loaded into the internal cavity (e.g., internal wet space 18) of the chamber 12 and held by a vacuum force. In some embodiments, the deployable payload 19 is loaded in an orientation such that the base of the payload 12 is flush with the vehicle, as visible in FIG. 2, to create a seal capable of preventing the payload 19 from unintentionally falling away from the vehicle prior to the initiated deployment.

The payload 19 may be any suitable unit desired to be deployed underwater capable of withstanding water immersion. In one embodiment, the payload 19 is a marker, a beacon, a navigation device, an expendable buoy, a sonar calibrating device (such as described in U.S. patent application Ser. No. 14/844,038), or other suitable location-reporting device. In other embodiments, the deployable payload 19 is a sensor or array of sensors (e.g., conductivity, temperature, moisture, motion, seismic, light, pressure, acoustic, gaseous composition), a transmitter, a munition (e.g., a mine), robot, optical device (e.g., a spectrometer, an interferometer, a photometer), an acoustic communication or signaling device (e.g., pinger, modem), an optical communication or signaling device (such as a communication unit such as found in U.S. Pat. No. 7,953,326), a hydrophone, an actuator, a light, a strobe, a camera, a sampler, any suitable type of a transducer, a transponder, or a transceiver, or any combination thereof.

In the preferred embodiment, the deployable payload 19 comprises a main water-tight (e.g., gas-tight, sealed) body housing 23 or enclosure with an internal space for the payload circuitry 32, a power source, a self-orienting assembly 24, and a leg release mechanism. In general, the water-tight body housing 23 is a suitable compartment which even upon light to moderate impact (and in some cases heavy impact), the water-tight body housing 23 prevents the entry of fluid as well as environmental contaminants (e.g., salt, biofouling) into the internal space.

In one embodiment, the power source may comprise one or more batteries, including but not limited to alkaline, nickel cadmium, nickel metal hydride, lead acid, lithium, or lithium polymer. In one embodiment, the vehicle may perform battery diagnostics and acquire and/or relay information of the status of battery charge or battery life of each payload 19 to a designated location such as a vessel, a buoy, a float, a land facility, or other site.

The deployable payload 19 may be of a low relief (i.e., low vertical profile) and compact form. A compact design allows the inventive system to load multiple payloads 19 within a compact space such as the narrow hull of an AUV. Furthermore, a low relief payload is able to sit on the seafloor with minimalized disturbance from the motion, drift, or current of the water. In some applications, the deployable payload 19 is made of a low relief to reduce the overall profile with respect to active sonar in covert operations.

In one embodiment, the deployable payload 19 is placed on the water bottom floor; in another embodiment, the deployable payload 19 is released and remains hovering (e.g., floating) over the water bottom floor tethered to a weight (e.g., anchor) (not shown). In the embodiment that includes a tethered payload, the payload is suspended from the bottom of the water body at a distance found suitable by the operator. In the preferred embodiment, the deployable payload 19 may also be fabricated to meet the criteria for a particular depth of water.

Each deployable payload 19 may be designated a specific identifier (e.g., number, code, physical marking), recorded in the payload circuitry 32, to distinguish one payload 19 from others deployed in the area. In some embodiments, each payload 19 is identical in appearance and interchangeable with other payloads 19 and with other deployment chambers 12 in the carrier 11. The deployable payload 19 may contain data information or location-determining devices, acoustic or optical communication components, and identity assignment via infrared data association (IrDA) links to allow communication with the vehicle or other remote location. A specific identity may be assigned to each individual payload 19 by the vehicle via the vehicle's electronics or via a remote signal provided by operator. This may be accomplished through the data communication path 29 which provides a water-tight connection between the payload 19 in the internal wet space 18 and the dry space 17 (FIG. 4B). In most cases, the payload 19 is capable of acoustic communications.

In some embodiments, the deployment chamber 12 comprises more than one payloads 19 which release together when deployment in initiated by the operator. In such instances, each payload 19 may be identical in function (i.e., comprise the same communication components, sensors, signaling devices, etc.) or each may serve a unique function such as one payload for location-reporting and another payload for sensing surrounding parameters.

Self-Orienting Assembly. In the preferred embodiment, the system will further comprise self-orienting assembly to allow the payload to correct its orientation. Positioning and orientation are important factors in accomplishing effective underwater operation of deployable payloads 19 on the seafloor. Orientation is particularly important in cases when the payload 19 is a communication node with directional signaling communication. Each deployed payload 19 generally falls away from the vehicle above the targeted position which can range from being deployed a couple of inches from the seafloor up to several hundred feet above the bottom, and in some instances several thousand feet above the bottom. Therefore, the payload 19 is likely to be disoriented upon contact with the bottom and often needs to be realigned to an upright operational position.

The deployable payload 19 comprises a self-orienting assembly 24 which allows the payload 19 to correct its orientation without external assistance. The self-orienting assembly 24 is characterized by a set of stabilizing leg supports comprising one or more stabilizing legs, referred to as the leg assembly 25, attached to the body of the deployable payload 19 as a means properly orient or level the deployed payload 19 in a functional position on the underlying surface (i.e., seafloor). In preferred embodiments, the self-orientating assembly orients the payload 19 to an upright position. Such self-orientation may be critical for directional communications or minimalized shuffling around the seafloor when in operation. Upon release to a desired location, the payload 19 may land on its side or other unsuitable position. Therefore, the leg assembly 25 is employed to extend the leg supports out and away from the body of the payload 19 to correct and stabilize the orientation. Such an assembly 25 may also dig into the water bottom floor to prevent unintended movement caused by the natural motions of the water.

Figure 5A:
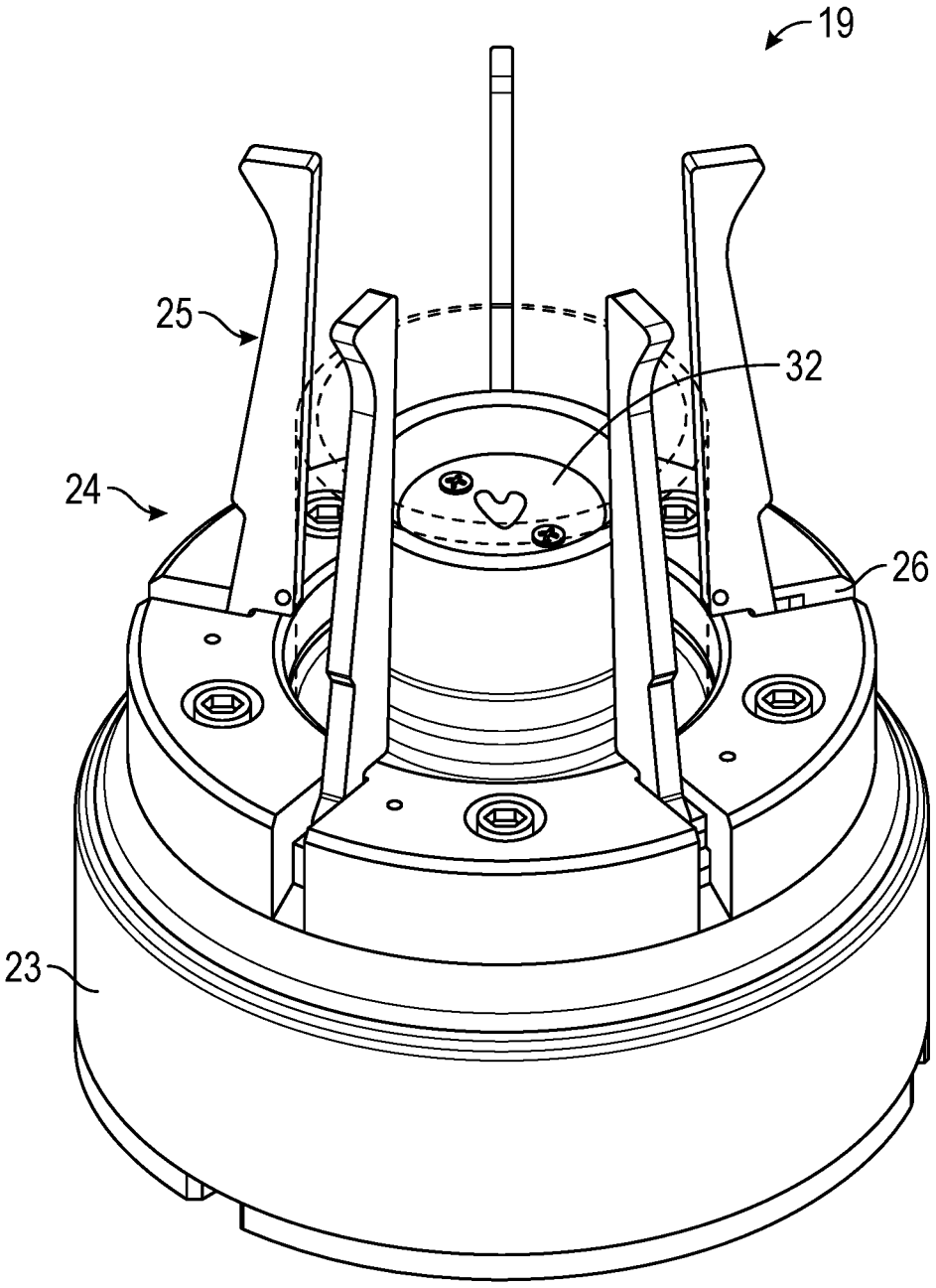
FIG. 5A depicts one embodiment of the deployable payload.

As shown in FIG. 5A, the self-orienting assembly 24 is comprised of the leg assembly 25, leg attachment points 26, and a leg release mechanism 27. The legs are attached to the water-tight body housing 23 of the payload 19 at the leg attachment points 26 wherein this attachment point 26 is the point of leg rotation. In some embodiments, the legs are attached to the water-tight body housing 23 by springs. In other embodiments, the stabilizing legs are attached to the main body by hinges, pins, or similar means. In the preferred embodiment, the legs are substantially equally spaced and secured to the water-tight body housing 23 of the payload 19. In an additional embodiment, particularly when internal components in the payload 19 are not equally distributed in weight resulting in one side of the payload 19 to be heavier than the other, the legs are secured to the payload 19 at positions to counter a difference in weight contribution and stabilize the payload 19 on the underlying floor.

Figure 5B:
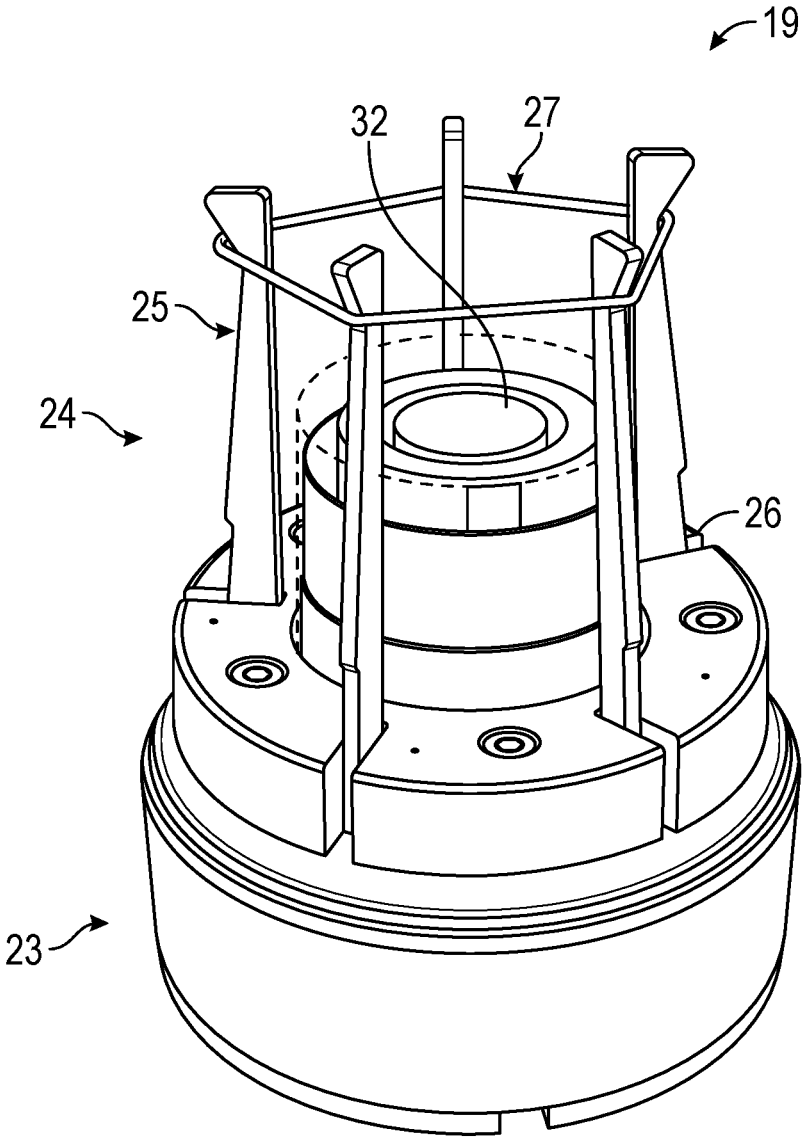
FIG. 5B depicts the deployable payload in the stowed position wherein the leg assembly is secured by the engaged leg release mechanism.
Figure 5C:
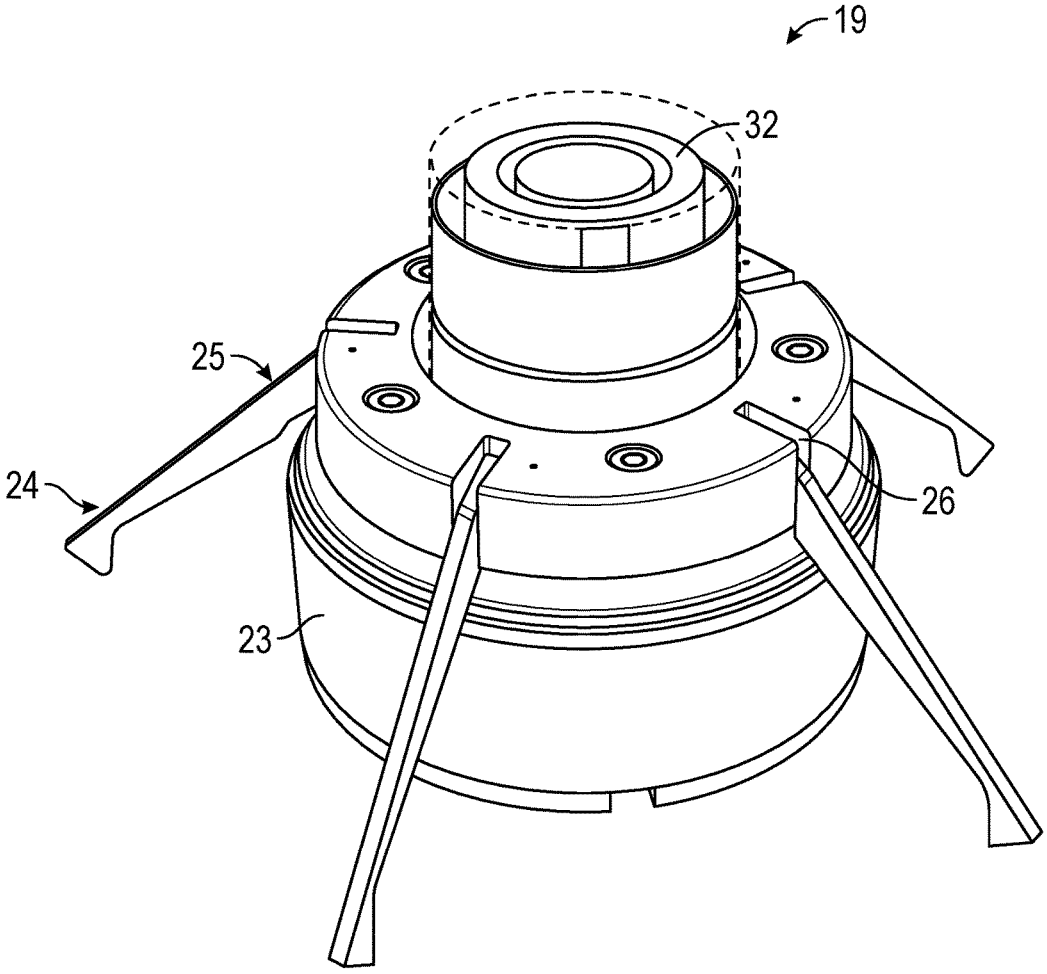
FIG. 5C depicts one embodiment of the deployable payload wherein the leg release mechanism is disengaged and the leg assembly is allowed to extend and stabilize the payload.

Prior to deployment, the leg assembly 25 remains secured in a stowed position by the leg release mechanism 27. In some embodiments, the leg assembly 25 is secured in an upright position with the legs angled toward the center of the water-tight body housing 23 of the deployable payload 19 (FIG. 5A). However, the leg assembly may be stowed in any suitable position to prevent the legs from prematurely engaging with a surrounding surface. Once the deployable payload 19 has been released from the vehicle 's carrier 11, the payload 19 falls to the water bottom floor, and the leg assembly 25, secured in the upright position, is released, allowing the stabilizing legs to pivot and extend downward (FIG. 5B). The legs then pivot at their point to rotation (i.e., attachment point 26 to the water-tight body housing 23) and contact the underlying water bottom floor.

There are multiple methods by which the leg release mechanism can be engaged. In one embodiment, the leg release mechanism 27 is time-delayed slightly after deployment to allow the payload 19 to first make contact with the water bottom floor prior to releasing the stabilizing legs from their initial stowed position. In other embodiments, the leg release mechanism 27 is delayed only until the payload 19 has exited the deployment chamber 12, allowing the legs to be extended prior to contact with the ground. In still other embodiments, the leg release mechanism 27 is delayed until a signal is provided to the payload 19 to release the leg assembly 25. In some applications, the leg release mechanism 27 is controlled by a dissolvable substance (e.g., dissolvable band, dissolvable holder, water-soluble ring), which upon contact with fluid dissolves, releases the leg assembly 25, and allows the legs to pivot and extend from the water-tight body housing 23 of the payload 19 for orientation. In other embodiments, the leg release mechanism 27 is disengaged by a timed-release device, which after a specific amount of time after deployment allows the legs to extend and orient the payload 19. In some embodiments, the leg release mechanism 27 is part of the carrier 11 and releases the leg assembly 25 upon deployment.

Leg Release Mechanism. The sequence of the leg release process involves the vehicle first determining the desired location and/or time to release the deployable payload 19. The vehicle may remain in motion, in buoyant suspension, or may rest at the bottom of the water body until signaled to initiate deployment of the payloads 19. Upon initiation of deployment, the actuation assembly internal to the carrier 11 or other seal-breaking means is opened to an inflow of fluid (e.g., fluid, water, seawater, fresh water) which disengages the vacuum seal holding the deployable payload 19 in place and allows the payload 19 to fall away or be released.

Simultaneously, as the deployable payload 19 is falling away from the vehicle, the now void internal space of the deployment chamber 12 becomes available to completely or at least partially fill with fluid, immediately compensating the weight of the deployed payload 19. This process may then be independently repeated with more or all of the remaining deployable payloads 19 still stowed aboard the vehicle. In some embodiments, only one or a portion of the available deployable payloads 19 is deployed from the vehicle. In most cases, no additional changes are required by the operator of the vehicle to compensate for the changes in weight (i.e., ballast).

Buoyancy Compensation Method. A fundamental challenge in the design and utilization of an underwater vehicle for the deployment of underwater objects is the need to counteract the effects of weight changes of the platform, particularly a vehicle, as objects are deployed. It is optimal during underwater operations to minimize the range of buoyancy changes and ensure that the vehicle maintains and adequately controls depth adjustment in water. As weights (i.e., payloads) are removed from the vehicle, buoyancy increases, potentially offsetting the expected trajectory of the vehicle if not properly compensated. Therefore, it is necessary to employ practically and ideally automatic methods to adjust for weight changes as payloads are deployed. Additionally, it may be advantageous for certain operations to provide a system which deploys payloads and compensates for their weight in a quiet manner without excess mechanical noise and substantial amounts of air bubbles.

These changes in buoyancy may be minimized by a fluid-based buoyancy compensation method wherein the weight lost by the deployment of the payload is compensated by a weight of fluid (e.g., water, seawater, fresh water). In one embodiment, this is accomplished by a passive means in which the internal wet space 18 of the deployment chamber 12 holding the deployable payload 19 provides the space to allow fluid to enter the platform and compensate for the missing payload's weight. In other embodiments, initiation of deployment actuates the opening of valves and/or associated components, specifically the actuation assembly, such that the vacuum force holding the payload 19 is disengaged, the payload 19 is deployed, and the internal wet space 18 fills with a compensating weight of fluid. This operation of the buoyancy compensation method occurs in the components inside bracket 33 on FIG. 4A.

In some applications, no additional mechanical devices are necessary such as pumps, motors, or other means to bring fluid into the vehicle. In others, fluid is pumped into the cavity of the deployment chamber 12 via a suitable pump to break the vacuum seal holding the payload 19 and causing the payload 19 to be released from the vehicle.

In some cases, the internal wet space 18 is sized to accommodate additional weight-assistance items such as weights, flotation devices (e.g., buoys, inflatables, foam, buoyant objects), or other suitable means to compensate for weight changes upon the deployment of the payload 19. In such cases, the payload 19 may be of a weight too light (i.e., weight of the payload is less than the weight of the wet space volume filled with fluid) and may require additional weights to be deployed at the same time with the payload 19 for weight changes to be equalized and fully countered by a fluid. Furthermore, if the payload 19 is of a weight too heavy (i.e., weight of payload is greater than the weight of the wet space volume filled with fluid), additional flotation devices may be stored in the carrier and deployed at the time of the deployable object for the changes in weight to be equalized by a volume of water to fill the cavity.

In some embodiments, the deployable payload 19 is of a heavier weight (i.e., heavier than the weight of the deployment chamber's wet space volume filled with fluid), and the chamber 12 is redesigned to encompass a larger volume of fluid than the volume of the payload 19. In other embodiments, the deployable payload 19 is of a lighter weight (i.e., lighter than the weight of deployment chamber's wet space volume filled with fluid), and the chamber 12 is redesigned in such a way to accommodate a smaller volume of fluid than the volume of the payload 19.

The buoyancy compensation method may compensate for the entire weight, volume, and/or density of each payload 19 deployed from the vehicle, where certain circumstances exist wherein a partial ballast compensation is desired. In some embodiments, the buoyancy compensation method only partially offsets the weight of the deployed payloads which allows the vehicle to change in buoyancy. Depending on the weight of the payload 19 and the weight of the fluid (as described above), the vehicle may be designed to become more or less buoyant over the course of deployment.

In the determination of the size and volume of the deployment chamber's wet space 18, a fluid displacement test may be employed to establish the amount of fluid displaced by the size of the payload 19 also taking into account the density of the fluid in which the payload 19 is submerged. Additionally, another aspect that must be taken into account is the density of the fluid of which is replacing the weight of the deployed payload 19 as seawater comprises a higher density than fresh water. As such, adjustments to the weight of the payload 19 or the volume of the storage cavity may be made to accommodate any significant weight differences.

The vehicle may be brought back up to the surface and allowed to passively drain to remove the compensating fluid weight. In other embodiments, the compensating fluid weight is pumped out of the vehicle by a mechanical device (e.g., pump).

After reviewing the present disclosure, those skilled in the art will know or be able to ascertain using no more than routine experimentation, many equivalents to the embodiments and practices described herein. For example, several underwater vehicles such as remotely operated vehicles (ROVs) and unmanned underwater vehicles (UUVs), gliders, as well as submersibles carrying one or more humans, may be used with the systems and methods described herein. Accordingly, it will be understood that the systems and methods described are not to be limited to the embodiments disclosed herein, but is to be understood from the following claims, which are to be interpreted as broadly as allowed under the law.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art and are within the following claims.

Reference throughout this specification to "one embodiment," "an embodiment," or similar language means that a particular feature, structure, or characteristic described in connection with the embodiment is included in at least one embodiment. Thus appearances of the phrase "in one embodiment," "in an embodiment," and similar language throughout this specification may, but do not necessarily, all refer to the same embodiment.

The invention claimed is:

1. An underwater vehicle for deployment of at least one payload in water, comprising:

a. a carrier, comprising a deployment chamber, comprising:
   i. an electrical port;
   ii. at least one valve;
   iii. an actuator;
   iv. at least one actuator switch;
   v. electronics and circuitry;
   vi. a vacuum port;
   vii. an internal wet space; and
   viii. a portal connecting the internal wet space to an external environment; and b. at least one payload;
c. a vacuum actuation mechanism;
wherein the carrier is connected to the vacuum port;
wherein the vacuum port is connected to the vacuum actuation mechanism;
wherein when the deployment chamber is fully sealed, a vacuum force is created within the deployment chamber;
wherein the payload is held solely by the vacuum force;
wherein fluid is allowed to flood the internal wet space, releasing the vacuum force;
wherein the electrical port is capable of receiving power or data information; and
wherein the actuator and the actuator switch are controlled by the electronics and circuitry.

2. The device of claim 1, wherein the carrier may be connected to a vacuum source to create the vacuum force within the deployment chamber.

3. The device of claim 1, wherein the deployment chamber further comprises an O-ring.

4. The device of claim 1, wherein the payload comprises an O-ring.

5. The device of claim 1, wherein said carrier further comprises weights or flotation devices.

6. The device of claim 1, wherein said payload comprises:
a. a payload circuitry within a water-tight body housing; and
b. a power source.

7. The device of claim 1, wherein the payload comprises:
a. a payload circuitry within a water-tight body housing; and
b. a power source;
wherein the payload is capable of storing data information or location-determining devices.

8. The device of claim 1, wherein said payload comprises:
a. a water-tight body housing;
b. a payload circuitry within the water-tight body housing;
c. a power source; and
d. a self-orienting assembly;
wherein the self-orienting assembly is attached to the water-tight body housing.

9. The device of claim 1, wherein said payload comprises:
a. a water-tight body housing;
b. a payload circuitry within the water-tight body housing;
c. a power source;
d. a self-orienting assembly, comprising:
i. a leg assembly; and
ii. at least one leg attachment point;
wherein the leg assembly is comprised of at least one leg; and
wherein each at least one or more legs is connected to the water-tight body housing at a leg attachment point; and
wherein the self-orienting assembly is attached to the water-tight body housing.

10. An underwater vehicle for deployment of at least one payload in a body of water, comprising:
a. carrier, comprising a deployment chamber, comprising:
i. an internal wet space; and
ii. a portal connecting the internal wet space to the external environment; and
b. at least one payload, comprising:
i. a water-tight body housing;
ii. payload circuitry within the water-tight body housing;
iii. a power source; and
iv. a self-orienting assembly, comprising:
(1) a leg assembly;
(2) at least one leg attachment point; and
(3) a leg release mechanism;
wherein the leg assembly is comprised of at least one leg;
wherein each of the at least one legs is connected to the water-tight body housing at a leg attachment point; and
wherein the leg assembly remains in a stowed position until the leg release mechanism releases the at least one leg; and
wherein said payload is capable of supporting a vacuum force within the chamber therein; and
wherein the self-orienting assembly is attached to the water-tight body housing;
wherein when the deployment chamber is fully sealed, the vacuum force is created within the deployment chamber; and
wherein the payload is held solely by the vacuum force within said chamber and wherein fluid is allowed to flood the internal wet space, releasing the vacuum force.

11. A method for the underwater deploying of at least one payload in a body of water comprising:
a. placing a carrier that contains a deployment chamber comprising:
i. an electrical port;
ii. at least one valve;
iii. an actuator;
iv. at least one actuator switch;
v. electronics and circuitry;
vi. a vacuum port;
vii. an internal wet space; and
viii. a portal connecting the internal wet space to an external environment;
b. placing at least one payload comprising a self-orienting assembly, comprising:
i. a leg assembly;
ii. at least one leg attachment point; and
iii. a leg release mechanism;
into the deployment chamber through the portal;
c. holding said payload in said chamber through the use of a vacuum force;
d. placing the carrier in a location where the payload will be deployed; and
e. triggering a release of the payload;
f. wherein, upon triggering the release of the payload, fluid is allowed to flood the internal wet space, releasing the vacuum force; and
g. wherein upon deployment of the payload, the self-orienting assembly reorients the payload after deployment;
h. wherein the body of water comprises a water bottom floor; and
i. the leg assembly digs into the water bottom floor.

12. The method of claim 11, wherein the body of water comprises a water bottom floor, and upon payload release, the payload drops from the carrier through the body of water until it reaches the water bottom floor.

13. The method of claim 11, wherein the carrier further comprises a vacuum source, wherein the vacuum force is created by connecting the valve to the vacuum source and disconnecting the vacuum source once a seal has been created between the payload and the deployment chamber.

14. The method of claim 11, wherein the carrier further comprises a vacuum source, wherein the vacuum force is created by connecting the at least one valve to a vacuum source and stays connected during use to maintain the seal between the payload and the deployment chamber.

15. The method of claim 11, wherein the payload is forced out of the deployment chamber by use of at least one spring.

16. The method of claim 11, wherein upon deployment of the payload, the self-orienting assembly reorients the payload after deployment.

17. The method of claim 11, the self-orienting assembly is time-delayed and reorients the payload at a designated time after deployment.

* * * * *